US005975061A

United States Patent [19]

Briggs et al.

[11] Patent Number: 5,975,061

[45] Date of Patent: Nov. 2, 1999

[54] BYPASS FUEL PRESSURE REGULATOR

[75] Inventors: Paul F. Briggs, Wolcott; George H. Bucci, South Windsor, both of Conn.

[73] Assignee: Walbro Corporation, Cass City, Mich.

[21] Appl. No.: 09/024,781

[22] Filed: Feb. 17, 1998

[51] Int. Cl.[6] ..... F02M 37/04

[52] U.S. Cl. ..... 123/514; 137/541

[58] Field of Search ..... 137/115.16, 569, 137/541; 123/514, 509, 510

[56] References Cited

U.S. PATENT DOCUMENTS

| | | | |
|---|---|---|---|
| 4,181,144 | 1/1980 | Landen | 137/541 |
| 4,294,281 | 10/1981 | Gerdes | 137/541 |
| 4,938,254 | 7/1990 | Gimby | 137/541 |
| 5,137,050 | 8/1992 | Clarke | 137/541 |
| 5,195,494 | 3/1993 | Tuckey | 123/514 |
| 5,398,655 | 3/1995 | Tuckey | 123/514 |
| 5,443,092 | 8/1995 | Farnsworth | 137/541 |
| 5,472,013 | 12/1995 | Irgens | 137/541 |
| 5,655,504 | 8/1997 | Iwai | 123/514 |
| 5,727,529 | 3/1998 | Tuckey | 123/514 |

*Primary Examiner*—Carl S. Miller

*Attorney, Agent, or Firm*—Reising, Ethington, Barnes, Kisselle, Learman & McCulloch, P.C.

[57] ABSTRACT

A bypass fuel pressure regulator disposed downstream of and in communication with a fuel pump outlet to bypass at least a portion of the outlet fuel from the fuel pump corresponding to the engine's fuel demand. The regulator has a bypass passage with an inlet in communication with the fuel pump outlet and an outlet in communication with the fuel tank. A valve assembly is received in and controls the flow of fuel through the bypass passage. The valve assembly has a disc carried on one end of a stem which has an enlarged valve head adjacent its other end which is movable to open and close an outlet opening of the regulator. The disc is disposed generally transverse to the axis of the bypass passage and upstream of the valve head. The disc has at least one and preferably several openings through which fuel flows into the bypass passage through the disc. A spring is received between the regulator body and the disc to yieldably bias the valve head onto a valve seat to close the regulator outlet. When the fuel pump delivers more fuel than is immediately necessary to operate the engine, the valve head is displaced from the valve seat to return the excess fuel to the fuel tank.

21 Claims, 1 Drawing Sheet

BYPASS FUEL PRESSURE REGULATOR

FIELD OF THE INVENTION

This invention relates generally to fuel pressure regulators and more particularly to a bypass fuel pressure regulator for controlling the pressure and flow rate of liquid fuel delivery from a fuel pump to an engine.

BACKGROUND OF THE INVENTION

In many engines with fuel injection systems, it is desirable to supply liquid fuel to the fuel injector or injectors from a fuel pump which continuously delivers a flow rate of liquid fuel sufficient to supply the maximum fuel demand of the engine and hence, under engine operating conditions wherein the engine has a lesser fuel demand, there is an excess of fuel being supplied from the fuel pump. This is especially true when the engine is idling and has an extremely low fuel demand while the fuel pump is still delivering a high flow rate of fuel.

In such systems, a bypass regulator is utilized to provide a bypass fuel flow path downstream of the pump outlet through which excess fuel delivered from the fuel pump is returned to the fuel tank. The fuel pressure regulator may be located within the fuel tank immediately downstream of the fuel pump outlet to bypass excess fuel delivered from the fuel pump directly into the fuel tank. The fuel pressure regulator may also be located downstream of the engine fuel rail or injectors to bypass excess fuel to the fuel tank through a fuel return line. In this way, the pump can be continuously operated to maintain a high rate of fuel output so as to be able to accommodate a rapidly increasing demand for fuel at the engine.

Some previous fuel pressure regulators have used a flexible diaphragm spring biased to close a bypass passage. The diaphragm is responsive to an increase in fuel pressure acting thereon and when displaced, permits the fuel to flow through the bypass passage to be returned to the fuel tank. Although satisfactory in performance, and beneficial for the ability to accommodate thermally expanding or excess fuel, these fuel pressure regulators have a relatively slow response time causing undesirable fuel pressure pulsations which can affect the performance of the engine and can generate undesirable levels of noise in the fuel system. Further, due to the increased force per unit of displacement of the spring biasing the diaphragm, these regulators inherently produce an outlet fuel pressure delivered to the engine which decreases with increasing flow rate of fuel delivered to the engine. In some applications, it is desirable to provide fuel at a substantially constant pressure to the fuel injectors regardless of the flow rate of fuel delivered or at a pressure which increases with an increasing flow rate of output fuel delivered to the engine. Thus, it is desirable to have a highly responsive fuel pressure regulator which is versatile and may be easily calibrated to provide constant or increasing fuel pressure with increasing flow rate of output fuel delivered to the fuel injectors of the engine.

SUMMARY OF THE INVENTION

A bypass fuel pressure regulator disposed downstream of and in communication with a fuel pump outlet to bypass at least a portion of the outlet fuel from the fuel pump in response to the engine's fuel demand. The regulator has a bypass passage with an inlet in communication with the fuel pump outlet and the engine and an outlet in communication with the fuel tank. A valve assembly is received in and controls the flow of fuel through the bypass passage. The valve assembly has a stem with an enlarged valve head adjacent one end which when seated closes an outlet opening of the regulator and a disc carried by the stem upstream of the valve head. The disc is disposed generally transverse to the axis of the bypass passage and preferably adjacent the inlet of the bypass passage. The disc has at least one and preferably several orifice openings through which fuel flows into the bypass passage through the disc. A spring received between the regulator body and the disc biases the valve head onto a valve seat to close the regulator outlet.

Fuel discharged under pressure from the fuel pump acts on the disc and a portion flows through the orifice openings in the disc creating a pressure drop across the disc and providing fuel under pressure acting on the valve head. The pressure differentials across both the disc and the valve head act against the force of the spring biasing the valve assembly to displace the valve assembly and disengage the valve head from the valve seat to open the outlet and permit bypass fuel to flow through the outlet to be returned to the fuel tank. With a high flow rate demand for fuel by the engine, such as under high engine speeds and loads, there is a relatively low pressure differential across the disc and valve head, a relatively low fuel flow rate through the regulator bypass passage, and hence, a relatively low flow rate of bypass fuel returned to the fuel tank. With a lower engine fuel flow rate demand, such as under low engine speeds and loads, there is an increased pressure differential across the disc and valve head causing an increased displacement of the valve head from the valve seat to provide a greater fuel flow rate through the regulator bypass passage and hence, a higher flow rate of bypass fuel returned to the fuel tank. The spaced disc and valve head construction provides a bypass fuel pressure regulator which is extremely responsive to changing engine fuel flow rate conditions in the fuel system to reduce pressure pulsations and thereby increase the efficiency and decrease the noise of the fuel system in use.

The pressure as a function of flow rate of fuel supplied to the engine by the bypass fuel pressure regulator can be varied significantly by changing the relative surface areas of the disc and valve head, the spring rate of the spring biasing the regulator valve assembly and/or changing the size of the openings through the disc to control the displacement of the head from the valve seat under various fuel flow rate conditions. By changing the surface areas of the disc and valve head, the size of the openings through the disc and/or the spring rate of the spring, the bypass fuel pressure regulator can provide a substantially constant pressure of fuel delivered to the fuel injectors of the engine over a wide range of flow rates, can provide an increasing pressure of fuel delivered to the fuel injectors with an increasing fuel flow rate delivered to the engine, and can even provide a pressure of fuel delivered to the fuel injectors which decreases as the fuel flow rate increases, although this is usually not desirable for most applications.

Objects, features and advantages of this invention include providing a bypass fuel pressure regulator which is highly responsive to changes in engine fuel flow rate demand, reduces pressure pulsations within the fuel system, is readily adaptable to various fuel systems, can be readily calibrated to provide a substantially constant output fuel pressure over a wide range of bypass flow rates, or an output fuel pressure which increases with an increasing output fuel flow rate, or an output fuel pressure which decreases with an increasing output fuel flow rate, can be placed substantially anywhere in the fuel system downstream of the fuel pump outlet, is of relatively simple design and economical manufacture and assembly, is reliable and durable and has a long useful life in service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
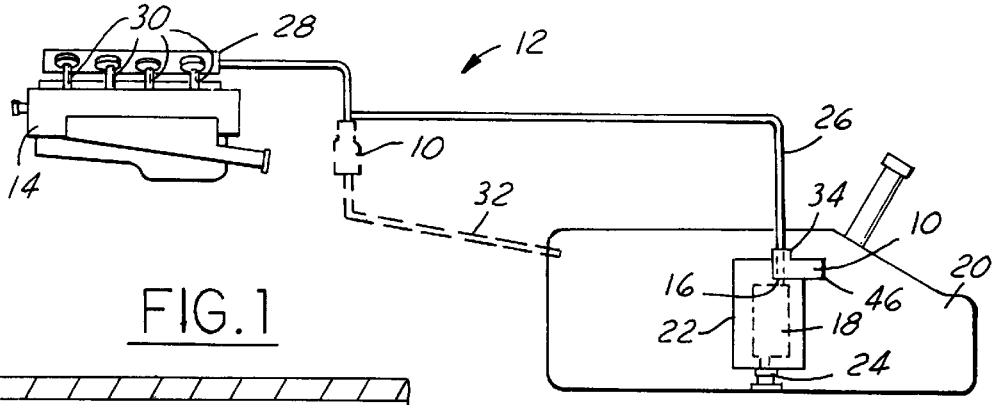
FIG. 1 is a diagrammatic view of a vehicle fuel system having a bypass fuel pressure regulator embodying this invention.

Referring in more detail to the drawings, FIG. 1 illustrates a bypass fuel pressure regulator 10 in a fuel system 12 for supplying liquid fuel such as gasoline to an internal combustion engine 14. The bypass fuel pressure regulator 10 is in communication with the outlet 16 of a fuel pump 18 and returns excess fuel to a fuel tank 20 when the output of the fuel pump 18 is greater than the fuel demand of the operating engine 14. The fuel pump 18 is preferably disposed within a fuel pump module 22 in the fuel tank and has an inlet 24 adjacent the bottom of the fuel tank 20 through which fuel is drawn from the fuel tank 20 and the outlet 16 through which fuel is discharged under pressure through a fuel line 26 to be delivered to the fuel rail 28 and fuel injectors of engine 14. Preferably the bypass fuel pressure regulator 10 is disposed within the fuel tank 20 immediately downstream of the fuel pump as shown in FIG. 1, and when so disposed, returns excess fuel delivered from the fuel pump outlet 16 directly to the fuel tank 20 or the module 22. Alternatively (as shown in phantom) the bypass fuel pressure regulator 10 may be disposed downstream of the fuel tank 20 substantially anywhere along the fuel line 26, and may be connected to the downstream end of a fuel rail 28 with excess fuel returned to the tank 20 or the module 22 through a return fuel line 32.

Figure 2:
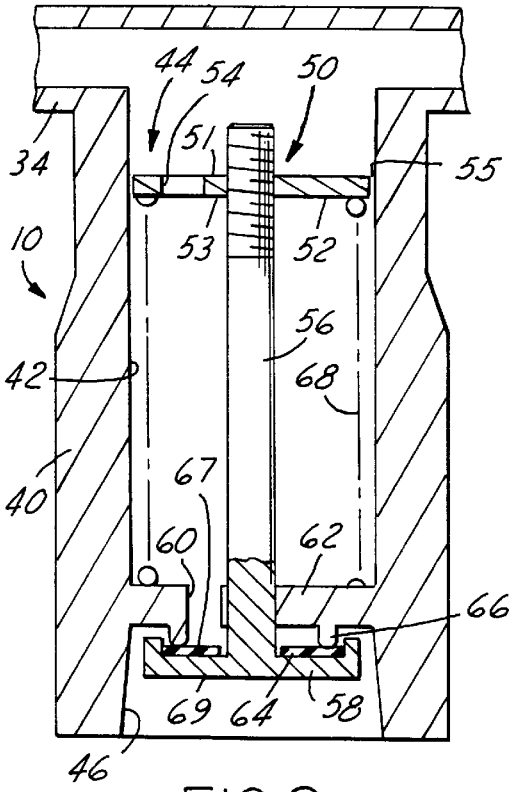
FIG. 2 is a cross sectional view of the bypass fuel pressure regulator of the invention with a valve assembly of the regulator shown in a closed position.

As shown in FIG. 2, the bypass fuel pressure regulator 10 has a body 40 defining a bypass passage 42 which has an inlet 44 communicating through a T-fitting 34 with the fuel pump outlet 16 and the fuel line 26 and an outlet 46 communicating with the fuel tank 20 or module 22 directly or through the return fuel line 32 (FIG. 1). A regulator valve assembly 50 is received in the bypass passage 42 and is constructed to control the flow of fuel through the passage 42 to thereby control the pressure of fuel delivered to the engine 14 corresponding to the engine's fuel demand.

The valve assembly 50 has a circular disc 52 disposed adjacent the inlet 44, slidably received in the bypass passage 42 and extending generally transverse to the longitudinal axis of the passage 42. The disc 52 has generally flat and opposed upstream and downstream faces 51, 53 and at least one and preferably two or more openings 54 through which fuel may flow. The openings 54 are preferably generally equally circumferentially spaced from each other to provide more balanced forces on the disc 52 from the pressurized fuel acting on the disc 52. A lesser amount of fuel may also flow through a peripheral gap or clearance 55 between the disc 52 and the bypass passage 42. The disc 52 is connected to one end of an elongate stem 56 and is preferably threadably received on the stem 56 so that its axial location on the stem 56 may be changed to facilitate calibrating the regulator 10. An enlarged valve head 58 is disposed at the other end of the stem 56 to control the flow through at least one and preferably three or more equally circumferentially spaced outlet openings 60 of the bypass passage 42 formed through a lower wall 62 of the regulator body 40. Preferably, an annular disc 64 of a resilient polymeric material is disposed on the valve head 58 and communicates with an annular valve seat 66 depending from the wall 62 and encircling the outlet openings 60 to close and seal the passage 42. The valve head 58 is preferably yieldably biased into engagement with the valve seat 66 by a spring 68 disposed between the wall 62 and the disc 52.

Operation

In use, the fuel pump 18 draws fuel from within the fuel tank 20 and delivers it through its outlet 16 under pressure to be delivered to the fuel rail 28 and associated fuel injectors 30 of the operating engine 14. Preferably, the fuel pump 18 provides a substantially constant output fuel pressure and fuel flow rate which is at least sufficient to supply the maximum fuel demand of the engine 14. Therefore, the fuel pump 18 delivers excess fuel when the engine 14 has a lesser fuel demand than its maximum demand. Preferably the output of the fuel pump 18 exceeds the maximum engine fuel demand by at least about 10% to 20%.

Fuel discharged from the fuel pump outlet 16 communicates with the inlet 44 of the bypass fuel pressure regulator 10 and a portion of this fuel enters the bypass passage 42 through the openings 54 in the valve assembly disc 52 and through the peripheral gap 55 between the disc 52 and the bypass passage 42. Fuel flow through the openings 54 and gap 55 creates a pressure drop across the disc 52 providing a force on the disc tending to urge the valve 58 to its open position. In addition, the upstream face 51 has a greater effective surface area than the downstream face 53, due to the stem 56 extending through the disc 52, which tends to increase the force applied by the disc 52 to the stem 56 to urge the valve toward an open position. Also, a significant pressure differential exists across the valve head 58 which is acted upon by fuel under pressure within the regulator passage 42 on one side 67 and by the pressure within the fuel tank on its other side 69, which is at or near atmospheric pressure. This pressure differential also produces a force which urges the valve toward an open position. The pressure differentials across the disc 52 and the valve head 58 are opposed by the spring 68, and when greater than the spring force, displace the valve assembly 50 and disengage the valve head 58 from the valve seat 66 to open the outlet 46 of the regulator 10. When the outlet 46 is open, bypass fuel flows through the regulator passage 42 and is returned to the fuel tank 20 or module 22 directly from the outlet 46 or through the return fuel line 32.

The regulator 10 is highly responsive to changes in the engine's fuel demand to rapidly bypass fuel at a flow rate inversely proportional to the engine's fuel demand. The rapid response of the regulator 10 is due in part to the controlled restriction of the openings 54 through the disc 52 and the gap 55 about the perimeter of the disc 52 which provide a pressure drop across the disc 52 as fuel flows therethrough. Also, the difference in surface areas between the upstream and downstream faces 51, 53 of the disc 52, due to the stem 56, produces a net force on the disc 52 tending to open the valve head. Further, an increasing flow rate of fuel through the openings 54 and peripheral gap 55 of the disc 52 produces an increasing pressure drop downstream of the disc 52. This increasing pressure drop tends to offset the increasing opposing spring force on the disc 52 per unit of displacement of the spring 68. Reducing the combined flow area of the openings 54 and peripheral gap 55 will provide an increased differential pressure across the disc 52. Increasing the diameter of the stem 56 will decrease the surface area of the downstream face 53 of the disc 52 to also provide an increased net force on the disc 52 tending to open the valve head 58. By calibrating the size of the openings 54 and perimeter gap 55 around the disc 52 as well as the diameter of the stem 56, which accounts for the difference in surface area between the upstream and downstream faces 51, 53 of the disc 52, the differential pressure across the disc 52 and the net force on the disc 52 may be controlled to produce a force corresponding to and opposing the force of the spring 68 to affect the resulting increment of displacement of the valve head 58 from the seat 66 and thus, the effective flow area of the outlet 46 of the regulator 10.

Figure 3:
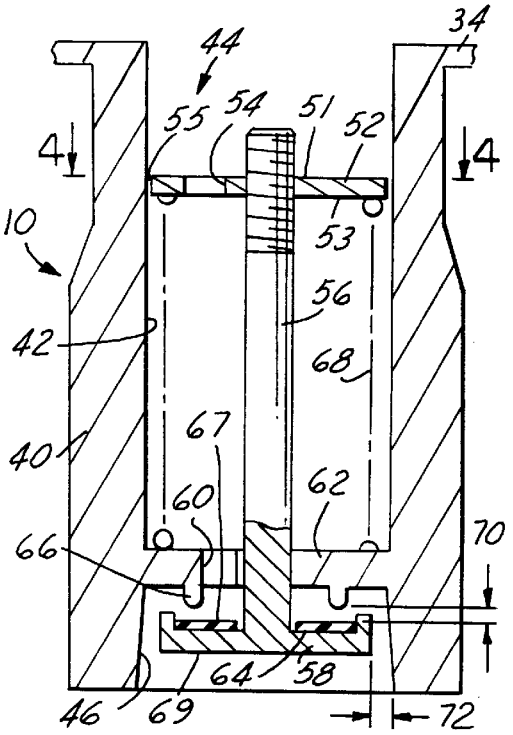
FIG. 3 is a cross sectional view of the bypass fuel pressure regulator with the valve assembly shown in an open position.
Figure 4:
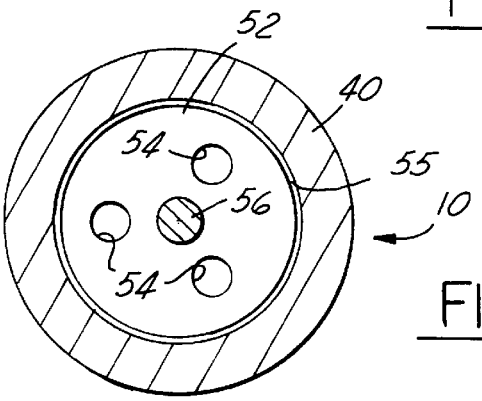
FIG. 4 is a sectional view of the bypass fuel pressure regulator taken generally on line 4–4 of FIG. 3.

Restriction to fuel flow through the outlet 46 is a function of the extent to which the valve head 58 is displaced from the valve seat 66 which controls the size of the gap 70 (FIG. 3) between the valve head 58 and valve seat 66 and the size of the gap 72 (FIG. 3) between the valve head 58 and the regulator body 40 if the outlet 46 is tapered. If the outlet 46 is not tapered, the size of the gap 72 will remain essentially constant regardless of the extent to which the valve head 58 is displaced from the valve seat 66 and will provide a restriction to fuel flow through the outlet at least when smaller than the size of the gap 70. These restrictions to fuel flow through the outlet 46 affect the pressure differential across the valve head 58 to further control the flow characteristics of fuel through the regulator 10 in response to the engine's fuel demand. The use of springs with different spring rates will also effect the balance of the valve assembly 50. Similarly, the initial spring force acting on the disc 52 can be varied and adjusted by rotating the disc 52 on the stem 56 to change the axial location of the disc 52 relative to the wall 62 when the valve head 58 is closed on the seat 66.

Thus, the pressure of fuel supplied to the engine over a wide range of flow rates can be controlled and maintained essentially constant or, if desired, varied as a function of the combined flow area of all of the openings 54 and the peripheral gap 55, the effective surface areas of the opposed faces 51, 53 of the disc 52, the spring rate of the spring 66 biasing the valve assembly 50, the initial biasing force of the spring 66, the pressure differential across the valve head 58, all of which control the extent of the displacement of the valve head 58 from the valve seat 66 which defines the effective bypass fuel flow outlet area for the regulator 10 and consequently the rate of flow of the bypass fuel. By varying these factors, the regulator 10 can be calibrated and constructed to provide a pressure of fuel supplied to the engine which is substantially constant over a wide range of fuel flow rates delivered to the engine, or an engine fuel pressure which increases with an increasing fuel flow rate to the engine.

Empirical data has shown that a regulator having a 0.39 inch bypass passage, a disc 52 about 0.38 inch in diameter, three orifices 54 through the disc 52 with each 0.053 inch in diameter, a stem 56 about 0.073 inch in diameter, a spring 68 with a spring rate of 3.26 lb/in, and an initial force of 2.1 pounds when the valve is fully closed, a valve head 58 about 0.34 inch in diameter a valve seat about 0.23 inch in mean diameter, and an outlet 46 about 0.39 inch in root diameter with a sidewall taper of 5° provides a pressure of fuel delivered to the engine which is essentially constant over a wide range of flow rates of fuel delivered to the engine. A regulator 10 having the same parameters except three orifices 54 through the disc 52, each about 0.060 inch in diameter provides an increasing pressure of fuel to the engine with an increasing flow rate of fuel delivered to the engine.

Thus, the regulator is extremely versatile and is adaptable to many applications to provide highly responsive and accurate control of the pressure of fuel delivered to the engine over a wide range of fuel flow rates delivered to the engine. Simple calibrations such as changing the spring used or changing the size of the disc 52 or the openings 54 therethrough can dramatically alter the fuel flow characteristics through the regulator 10 as desired for a particular fuel system 12.

We claim:

1. A bypass fuel pressure regulator for fuel supplied to an engine by a fuel pump comprising:

a body having a fuel inlet constructed to communicate with the outlet of a fuel pump, a fuel outlet constructed to supply fuel from the pump to an engine and a bypass outlet through which excess fuel delivered from the fuel pump is discharged;

a bypass passage formed in the body communicating the fuel inlet and outlet with the bypass outlet;

a valve assembly carried by the body and constructed to control the flow of fuel through the bypass passage, the valve assembly has a flow restricting member slidably received in the bypass passage and constructed to at least partially restrict the flow of fuel downstream thereof, a stem attached to the flow restricting member for co-movement therewith, a valve seat in the bypass passage downstream of the flow restricting member and a valve head attached to the stem for co-movement therewith and with the flow restricting member, the valve head being spaced from and downstream of the flow restricting member, yieldably biased into engagement with the valve seat and movable to selectively permit fuel flow therethrough so that under normal engine operating conditions, a sufficient fuel pressure differential exists across the flow restricting member and the valve head to displace the valve head from the valve seat to vary and control the rate of fuel discharged from the regulator through the bypass outlet to regulate and control the pressure of fuel supplied by the fuel pump to the engine.

2. The regulator of claim 1 wherein the flow restricting member is a disc disposed generally transversely to the axis of the bypass passage and having at least one opening through which fuel may flow.

3. The regulator of claim 2 wherein the disc has three openings.

4. The regulator of claim 1 wherein a spring received between the body and the flow restricting member yieldably biases the valve head into engagement with the valve seat.

5. The regulator of claim 2 wherein the bypass passage is generally circular in cross-section, the disc is circular and a gap is provided between the bypass passage and the disc, substantially about the perimeter of the disc, through which fuel may flow.

6. The regulator of claim 1 which also comprises a valve sealing member disposed between the valve head and the valve seat and constructed to provide a substantially fluid tight seal therebetween.

7. The regulator of claim 6 wherein the valve sealing member is a substantially resilient polymeric disc.

8. The regulator of claim 4 wherein the disc is threadedly received on the stem such that the axial position of the disc relative to the stem can be adjusted to adjust the force of the spring biasing the valve head.

9. The regulator of claim 2 wherein the disc has more than one opening with each opening of substantially the same size and generally equally circumferentially spaced.

10. The regulator of claim 4 wherein the body has a wall in the bypass passage between the disc and the valve head which carries the valve seat and has at least one opening therethrough encompassed by the valve seat and the spring is received between the disc and the wall of the body.

11. The regulator of claim 2 wherein each of the at least one opening defines a straight edge orifice whereby fuel flow through each opening produces a pressure drop downstream of the disc.

12. A system to supply fuel to an engine in response to the engine's fuel demand comprising:

a fuel tank;

a fuel pump having an inlet through which fuel is drawn from the fuel tank and an outlet through which fuel is discharged under pressure;

a bypass fuel pressure regulator having a fuel inlet in communication with the fuel pump outlet, a fuel outlet in communication with the fuel inlet and the engine, a bypass outlet in communication with the fuel tank or a module in the fuel tank, a bypass passage communicating the fuel inlet and outlet with the bypass outlet, and a valve assembly disposed in the bypass passage and constructed to control the flow of fuel through the regulator, the valve assembly has a flow restricting member slidably received in the bypass passage and constructed to at least partially restrict the flow of fuel downstream thereof, a stem attached to the flow restricting member for co-movement therewith, a valve seat in the bypass passage downstream of the flow restricting member and a valve head attached to the stem for co-movement therewith and with the flow restricting member, the valve head being spaced from and downstream of the flow restricting member, yieldably biased into engagement with the valve seat and movable to selectively permit fuel flow therethrough so that when the fuel pump is delivering more fuel than is needed for operation of the engine, a sufficient fuel pressure differential is generated across the flow restricting member and valve head to displace the valve head from the valve seat to vary and control the rate of fuel discharged from the bypass outlet to be returned to the fuel tank or module to control the pressure of fuel supplied by the pump to the engine.

13. The system of claim 12 wherein the bypass fuel pressure regulator is disposed within the fuel tank and fuel which flows through the bypass outlet is discharged directly into the fuel tank or module.

14. The system of claim 12 which also comprises a fuel line communicating the fuel pump outlet with the fuel inlet of the regulator and a return fuel line communicating the bypass outlet with the fuel tank or module, and the regulator is disposed exteriorly of the fuel tank between the fuel pump and the engine.

15. The system of claim 12 wherein the flow restricting member is a disc disposed generally transversely to the axis of the bypass passage and having at least one opening through which fuel may flow.

16. The system of claim 15 wherein the disc has three openings.

17. The system of claim 15 wherein the bypass passage is generally circular in cross-section, the disc is circular and a gap is provided between the bypass passage and the disc, substantially about the perimeter of the disc, through which fuel may flow.

18. The system of claim 15 wherein the disc has more than one opening with each opening of substantially the same size and generally equally circumferentially spaced.

19. The system of claim 15 wherein each of the at least one opening defines a straight edge orifice whereby fuel flow through each opening produces a pressure drop downstream of the disc.

20. The system of claim 12 which also comprises a spring received between the body and the flow restricting member and yieldably biasing the valve head toward engagement with the valve seat.

21. The system of claim 20 wherein the disc is threadedly received on the stem such that the axial position of the disc relative to the stem can be adjusted to adjust the force of the spring biasing the valve head.

* * * * *